US009816405B2

(12) United States Patent
Kizhakkethara et al.

(10) Patent No.: US 9,816,405 B2
(45) Date of Patent: Nov. 14, 2017

(54) ROCKER BASE FOR VALVE ACTUATION SYSTEM

(71) Applicant: Caterpillar Inc., Peoria, IL (US)

(72) Inventors: Indrajith Kizhakkethara, Peoria, IL (US); Prabhu Nagaraj, Tirunelveli (IN); Mallikarjuna Masala, Tamil Nadu (IN); John S. Pipis, Jr., Washington, IL (US); Karen E. Snelling, Battle Ground, IN (US); Michael J. Motyl, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 142 days.

(21) Appl. No.: 14/869,269

(22) Filed: Sep. 29, 2015

(65) Prior Publication Data

US 2017/0089224 A1 Mar. 30, 2017

(51) Int. Cl.

| | |
|---|---|
| ***F01L 1/02*** | (2006.01) |
| ***F01L 1/18*** | (2006.01) |
| ***F01L 1/14*** | (2006.01) |
| ***F01L 1/22*** | (2006.01) |
| ***F02F 7/00*** | (2006.01) |
| ***F01L 1/26*** | (2006.01) |
| ***F01L 1/32*** | (2006.01) |

(Continued)

(52) U.S. Cl.

CPC ..... *F01L 1/18* (2013.01); *F01L 1/146* (2013.01); *F01L 1/22* (2013.01); *F01L 1/26* (2013.01); *F01L 1/32* (2013.01); *F01L 1/46* (2013.01); *F01L 1/462* (2013.01); *F01L 3/08* (2013.01); *F01L 3/10* (2013.01); *F01L 3/22* (2013.01); *F02F 7/0021* (2013.01); *F01L 1/181* (2013.01); *F01L 1/20* (2013.01); *F01L 2103/01* (2013.01); *F01L 2105/00* (2013.01); *F01L 2820/01* (2013.01)

(58) Field of Classification Search

CPC ..... F01L 1/18; F01L 1/22; F01L 1/181; F01L 1/20; F01L 1/26; F01L 1/32; F01L 1/46; F01L 1/462; F01L 3/08; F01L 3/10; F01L 3/22; F01L 2103/01; F01L 2105/00; F01L 2820/01; F91L 1/146; F02F 7/0021

See application file for complete search history.

(56) References Cited

U.S. PATENT DOCUMENTS

| | | | |
|---|---|---|---|
| 2,397,502 | A | 4/1946 | Ralston |
| 2,624,323 | A | 1/1953 | Thome |

(Continued)

FOREIGN PATENT DOCUMENTS

| | | |
|---|---|---|
| CN | 203175694 U | 3/2013 |
| EP | 2 853 701 | 1/2015 |

OTHER PUBLICATIONS

U.S. Application entitled "Valve Actuation System" by Indrajith Kizhakkethara et al., filed Sep. 29, 2015.

*Primary Examiner* — Zelalem Eshete

(57) ABSTRACT

A rocker base is disclosed for use with a valve actuation system. The rocker base may have a housing with a top, a bottom, side walls connecting the top to the bottom, and end walls disposed between the side walls. The rocker base may also have rocker arm supports located inside the housing and integrally formed with the side walls, and an injector spring pad extending from one of the end walls toward a center of the housing. The rocker base may further have a rib connecting the injector spring pad to one of the rocker arm supports.

10 Claims, 3 Drawing Sheets

(51) Int. Cl.

| | |
|---|---|
| ***F01L 1/46*** | (2006.01) |
| ***F01L 3/08*** | (2006.01) |
| ***F01L 3/10*** | (2006.01) |
| ***F01L 3/22*** | (2006.01) |
| *F01L 1/20* | (2006.01) |

(56) References Cited

U.S. PATENT DOCUMENTS

| | | | | | |
|---|---|---|---|---|---|
| 2,662,511 | A | | 12/1953 | Sward | |
| 2,935,058 | A | | 5/1960 | Dooley | |
| 3,564,579 | A | | 2/1971 | Meacham et al. | |
| 3,853,101 | A | | 12/1974 | Iskenderian et al. | |
| 4,175,505 | A | | 11/1979 | Shimada et al. | |
| 4,203,397 | A | | 5/1980 | Soeters, Jr. | |
| 4,995,352 | A | * | 2/1991 | Machino ..... | F01L 1/18 123/90.27 |
| 5,226,389 | A | | 7/1993 | Buuck | |
| 5,711,260 | A | | 1/1998 | Aupperle et al. | |
| 6,244,231 | B1 | | 6/2001 | Kouchi et al. | |
| 6,484,683 | B2 | | 11/2002 | Zielke | |
| 8,136,496 | B2 | | 3/2012 | Wolck | |
| 8,210,144 | B2 | | 7/2012 | Langewisch | |
| 8,251,031 | B2 | | 8/2012 | Tsubakino et al. | |
| 8,434,544 | B2 | | 5/2013 | Fulton et al. | |
| 8,689,762 | B2 | | 4/2014 | Bach et al. | |
| 8,820,284 | B2 | | 9/2014 | Mori et al. | |
| 2015/0101555 | A1 | | 4/2015 | Rudolph | |

* cited by examiner

ROCKER BASE FOR VALVE ACTUATION SYSTEM

TECHNICAL FIELD

The present disclosure is directed to a rocker base and, more particularly, to a rocker base for a valve actuation system.

BACKGROUND

Each cylinder of an internal combustion engine is equipped with one or more gas exchange valves (e.g., intake and exhaust valves) that are cyclically opened during normal operation to allow fuel and air into the engine and to discharge exhaust from the engine. In a conventional engine, the valves are opened by way of a camshaft/rocker arm arrangement. The camshaft includes one or more lobes oriented at particular angles corresponding to desired lift timings and amounts of the associated valves. The cam lobes are connected to stem ends of the associated valves by way of the rocker arm, one or more cam followers, and associated pushrod linkage. As the camshaft rotates, the cam lobes cause the cam follower(s) to rise and fall, thereby generating a reciprocating motion in the associated pushrod linkage. The rising motion is translated to a first pivoting end of the rocker arm, thereby forcing a second pivoting end of the rocker arm downward against the stem ends of the gas exchange valves. This pivoting motion causes the valves to lift or open against a spring bias. As the cam lobes rotate away from the rocker arm, the valves are released and allowed to return to their closed positions.

The gas exchange valves, rocker arms, cam followers, pushrods, and/or springs of conventional valve actuation systems are contained inside a housing known as a rocker base. The rocker base sits atop a cylinder head of the associated engine, and includes mounting surfaces for the components of the valve actuation system. In this position, the rocker base supports loads transmitted by the valve actuation system into the cylinder head. For example, the rocker base may include a spring pad that supports loads associated with an injection rocker arm. The rocker base may also include open spaces (e.g., in and around the spring pad) that accommodate other components (e.g., push rods, cam followers, lash adjusters, etc.) that extend through the rocker base into the cylinder head. An exemplary rocker base is disclosed in U.S. Pat. No. 8,820,284 of Mori et al. that issued on Sep. 2, 2014.

Although acceptable for some applications, conventional rocker bases may not have sufficient strength or rigidity for other applications. For example, in applications that incorporate lash-adjusters, a required clearance around the lash adjusters may necessitate a reduced size of the associated spring pad. When the spring pad is reduced in size, a strength and/or rigidity of the spring pad may also be reduced. When this happens, it may be possible for the spring pad to fail prematurely when exposed to high-spring loads.

The rocker base of the present disclosure is directed towards overcoming one or more of the problems set forth above and/or other problems of the prior art.

SUMMARY

One aspect of the present disclosure is directed to a rocker base. The rocker base may include a housing with a top, a bottom, side walls connecting the top to the bottom, and end walls disposed between the side walls. The rocker base may also have rocker arm supports located inside the housing and integrally formed with the side walls, and an injector spring pad extending from one of the end walls toward a center of the housing. The rocker base may further have a rib connecting the injector spring pad to one of the rocker arm supports.

Another aspect of the present disclosure is directed to another rocker base. This rocker base may include a housing having a top, a bottom, side walls connecting the top to the bottom, and end walls disposed between the side walls. The rocker base may also include first and second rocker arm supports located inside the housing and integrally formed with the side walls, and an injector spring pad extending from one of the end walls toward a center of the housing. The injector spring pad may be centered between the rocker arm supports and inclined toward the top of the housing. The rocker base may also include first and second ribs connecting the injector spring pad to the first and second rocker arm supports. The first and second ribs may form a general V-shape, and open spaces may exist inside the housing at areas adjacent the spring pad.

Yet another aspect of the present disclosure is directed to an engine. The engine may include an engine block, a cylinder head connected to the engine block, a valve actuation system configured to selectively open passages in the cylinder head, and a rocker base connected to the cylinder head and configured to house the valve actuation system. The rocker base may have a housing with a top, a bottom configured to engage the cylinder head, side walls connecting the top to the bottom, and end walls disposed between the side walls. The rocker base may also have first and second rocker arm supports located inside the housing, being integrally formed with the side walls, and configured to support the valve actuation system. The rocker base may further have an injector spring pad extending from one of the end walls toward a center of the housing. The injector spring pad may be centered between the rocker arm supports and inclined toward the top of the housing. The rocker base may additionally have first and second ribs connecting the injector spring pad to the first and second rocker arm supports. The first and second ribs may form a general V-shape, and open spaces may exist inside the housing at areas adjacent the spring pad.

DETAILED DESCRIPTION

Figure 1:
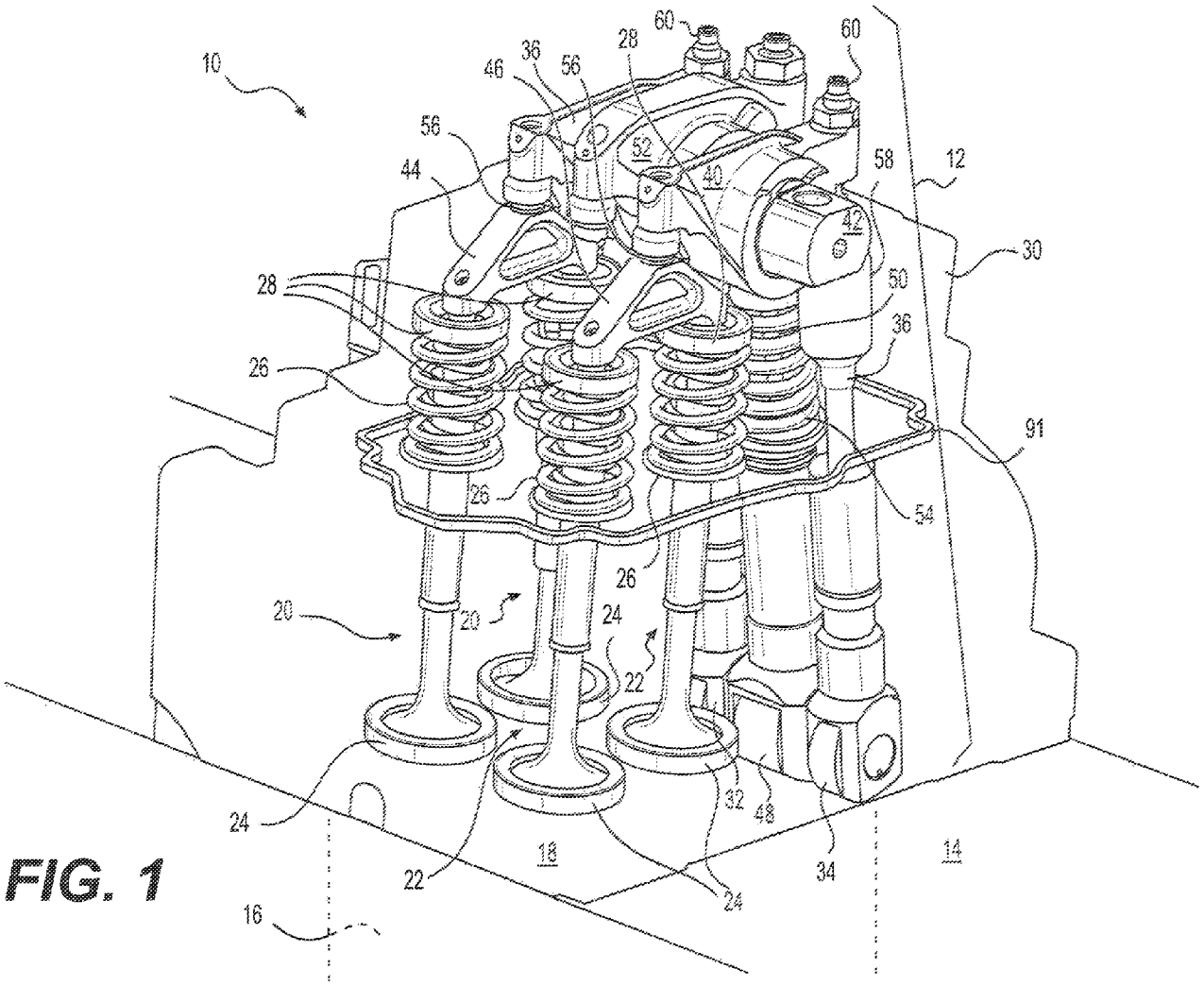
FIG. 1 is a pictorial illustration of an exemplary disclosed valve actuation system.

FIG. 1 illustrates an engine 10 equipped with an exemplary disclosed valve actuation system 12. For the purposes of this disclosure, engine 10 is depicted and described as a four-stroke diesel engine. One skilled in the art will recognize, however, that engine 10 may embody any type of combustion engine such as, for example, a four-stroke gasoline or gaseous fuel-powered engine. As will be described in more detail below, valve actuation system 12 may help regulate fluid flows through engine 10.

Engine 10 may include an engine block 14 that at least partially defines one or more cylinders 16. A piston (not shown) and a cylinder head 18 may be associated with each cylinder 16 to form a combustion chamber. Specifically, the piston may be slidably disposed within each cylinder 16 to reciprocate between a top-dead-center (TDC) position and a bottom-dead-center (BDC) position, and cylinder head 18 may be positioned to cap off an end of cylinder 16, thereby forming the combustion chamber. Engine 10 may include any number of combustion chambers; and the combustion chambers may be disposed in an "in-line" configuration, in a "V" configuration, in an opposing-piston configuration, or in any other suitable configuration.

Engine 10 may also include a crankshaft (not shown) that is rotatably disposed within engine block 14. A connecting rod (not shown) may connect each piston to the crankshaft so that a sliding motion of the piston between the TDC and BDC positions within each respective cylinder 16 results in a rotation of the crankshaft. Similarly, a rotation of the crankshaft may result in a sliding motion of the piston between the TDC and BDC positions. In a four-stroke engine, the piston may reciprocate between the TDC and BDC positions through an intake stroke, a compression stroke, a power stroke, and an exhaust stroke.

Cylinder head 18 may define one or more fluid passages (e.g., intake and exhaust passages—not shown) associated with each combustion chamber that are configured to direct gas (e.g., air and/or exhaust) or a mixture of gas and fluid (e.g., fuel) into or out of the associated chamber. The intake passage(s) may be configured to deliver compressed air and/or an air and fuel mixture into a top end of the combustion chamber. The exhaust passage(s) may be configured to direct exhaust and residual gases from the top end of the combustion chamber to the atmosphere.

System 12 may include a plurality of gas exchange valves (e.g., intake valves 20 and exhaust valves 22) positioned within the passages of cylinder head 18 to selectively engage corresponding seats 24 that are pressed into (or otherwise formed inside of) cylinder head 18. Each of the valves may be movable between a first position at which seat 24 is engaged to inhibit a flow of fluid through the corresponding passage, and a second position at which seat 24 is not engaged (i.e., at which the corresponding valve is lifted) and thereby allows a flow of fluid through the passage. The timing at which the valves are lifted, as well as a lift profile of the valves, may have an effect on the operation of the engine. For example, the lift timing and profile may affect production of emissions, production of power, fuel consumption, efficiency, temperature, pressure, etc. At least one spring 26 may be associated with each valve and configured to bias the valve toward the first position and against seat 24. A spring retainer 28 (also known as a rotocoil) may connect spring(s) 26 to a stem end of each valve.

System 12 may be mounted inside a base 30 that is operatively engaged with cylinder head 18, and consist of elements that move intake and exhaust valves 20, 20 against the biases of springs 26 from their first positions toward their second positions at desired timings. These elements of valve actuation system 12 may include, among other things, a plurality of cam followers (e.g., an intake follower 32 and an exhaust follower 34) configured to ride along a common camshaft (not shown) of engine 10, a pushrod 36 engaged with each cam follower, and a rocker arm (e.g., an intake arm 38 and an exhaust arm 40) configured to translate follower motion to the corresponding valves. Each rocker arm may be mounted to base 30 via a shaft 42, and connected to the corresponding valves by way of a bridge (e.g., an intake bridge 44 and an exhaust bridge 46).

In the disclosed embodiment, valve actuation system also includes an injector follower 48 located between intake and exhaust followers 32, 34. Injector follower 48 may be configured to ride along the common camshaft of engine 10, and a pushrod 50 may connect injector follower 48 to an injector arm 52 that is pivotally mounted to shaft 42 at a location between intake and exhaust arms 38, 40. A spring 54 may function to maintain contact between injector follower 48 and the camshaft. It is contemplated that injector follower 48, pushrod 50, injector arm 52, and spring 54 could be omitted, if desired.

The camshaft of engine 10 may operatively engage the crankshaft in any manner readily apparent to one skilled in the art, such that a rotation of the crankshaft results in a corresponding rotation of the camshaft. At least one cam lobe (not shown) may be formed on the camshaft and configured to drive a reciprocating motion of each of the associated followers as the camshaft rotates. With this configuration, an outer profile of any intake and exhaust cam lobes may determine, at least in part, the lift timing and profile of intake and exhaust valves 20, 22, respectively. Similarly, an outer profile of any injector cam lobe(s) may determine, at least in part, an injection timing and profile of an associated fuel injector (not shown for clarity) that is co-located inside base 30 and cylinder head 18.

An end of each of pushrods 36 may reside inside one of cam followers 32, 34 and move in accordance with the profile of the cam lobes as the camshaft rotates, thereby transferring a corresponding reciprocating motion to a first pivoting end of an associated rocker arm 38, 40. This reciprocating motion imparted to rocker arms 38, 40 may cause rocker arms 38, 40 to pivot about shaft 42, thereby creating a corresponding reciprocating motion at an opposing second end that lifts and releases intake and exhaust valves 20, 22, respectively. Thus, the rotation of the camshaft may cause intake and exhaust valves 20, 22 to move from the first position to the second position to create a specific lift pattern corresponding to the profile of the cam lobes.

Rocker arms 38, 40 may be connected to intake and exhaust valves 20, 22 by way of valve bridges 44, 46, respectively. Specifically, each of rocker arms 38, 40 may include a pin 56 that is received within the second ends of rocker arms 38, 40. A button-end of pin 56 may be able to swivel somewhat relative to the associated bridge 44 or 46, and includes a generally flat bottom surface that is configured to slide along a corresponding upper surface of the bridge 44 or bridge 46. The ability of the button-end of pin 56 to swivel and slide may allow rocker arms 38, 40 to transmit primarily vertical (i.e., axial) forces into valve bridges 44, 46. The only horizontal (i.e., transverse) forces transmitted between rocker arms 38, 40 and valve bridges 44, 46 may be relatively low and due only to friction at the sliding interface between pin 56 and bridges 44, 46. This interface may be lubricated and/or polished to reduce the associated friction.

In some applications, valve actuation system 12 may further include one or more lash adjusters 58 disposed within an upper end of pushrods 36, and an adjusting screw 60 located within the first end of rocker arms 38, 40. Lash adjusters 58 may be configured to automatically adjust a clearance between a corresponding intake or exhaust valve 20, 22 and its associated seat 24 (and/or between other valve train components) when the cam lobe is rotated away from pushrods 36. Adjusting screws 60 may be configured to connect rocker arms 38, 40 with pushrods 36 in a manually adjustable manner.

Figure 2:
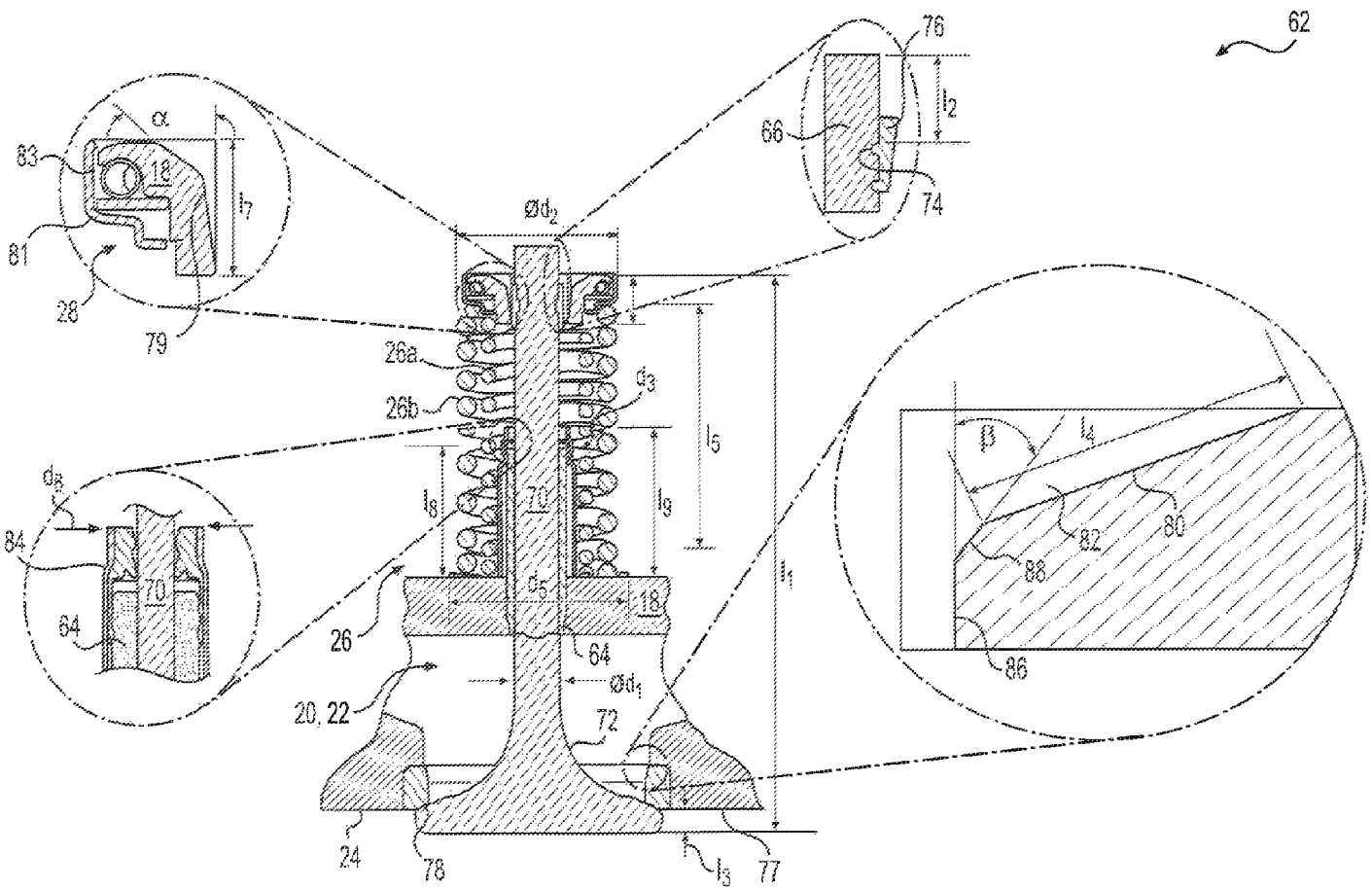
FIG. 2 is a diagrammatic illustration of an exemplary valve arrangement that may be used in conjunction with the valve actuation system of FIG. 1.

An exemplary valve arrangement 62 is illustrated in FIG. 2 and may be representative of an intake arrangement and/or an exhaust arrangement of system 12. As shown in this figure, the arrangement includes one of intake or exhaust valves 20, 22 disposed radially inside of seat 24, springs 26 (e.g., an inner and an outer spring 26*a* and 26*b*), and rotocoil 28. FIG. 2 also shows the one of intake or exhaust valves 20, 22 being disposed radially inside of a guide 64 that is at least partially mounted in cylinder head 18.

Each of intake and exhaust valves 20, 22 may include a tip 66 received within a pocket of the corresponding bridge 44 or 46, a head 68 located opposite tip 66, and a stem 70 connecting tip 66 to head 68. Stem 70 may join head 68 at a neck 72. One or more grooves 74 may be located at tip 66 and configured to receive inward annular protrusions of a keeper 76, which retains rotocoil 28 and springs 26 in their axial positions on the valve. The valve may have a stem diameter $d_1$, an overall length $l_1$, a length $l_2$ that extends from tip 66 to a closest one of keeper grooves 74, and a length $l_3$ that extends from a face of head 68 to a gauge plane 77. The dimensions $d_1$, $l_1$, $l_2$, and/or length $l_3$ may be the same or different for intake and exhaust valves 20, 22. In one specific embodiment, intake valve 20 has $d_1$ about equal to 11 mm, $l_1$ about equal to 218-219 mm (e.g., about equal to 218.86 mm), $l_2$ about equal to 16-17 mm (e.g., about 16.8 mm), and length $l_3$ about equal to 4.5-5 mm (about 4.72 mm). In this same embodiment, exhaust valve 22 has $d_1$ about equal to 12-13 mm (e.g., about 12.5 mm), $l_1$ about equal to 218-219 mm (e.g., about equal to 218.9 mm), $l_2$ about equal to 18.5-19 mm (e.g., about 18.9 mm), and length $l_3$ about equal to 3.5-4 mm (e.g., about 3.7 mm). In this same embodiment, intake valve 20 has multiple (e.g., two) keeper grooves 74, while exhaust valve 22 has a single keeper groove 74. It should be noted that, for the purposes of this disclosure, the term "about", when used in reference to a dimension, may be interpreted as "within manufacturing tolerances".

Seat 24 may be a replaceable wear component pressed into an existing recess in cylinder head 18. Seat 24 may be generally ring-like, with an internal conical sealing surface 78 located at an external end that is configured to be engaged by valves 20, 22 when valves 20, 22 are moved to their flow-blocking positions. To remove seat 24 from cylinder head 18, a tool (not shown) may be inserted through sealing surface 78 to engage a base end of seat 24. To facilitate this engagement, seat 24 may taper outward at the base end (i.e., the internal surface of seat 24 at the base end may have a conical surface 80), allowing a radially protruding wedge portion of the tool to fit into a void 82 created by the taper. An outward force may then be applied to the tool, causing the wedge portion to engage surface 80 and urge seat 24 out of the recess of cylinder head 18. Surface 80 may have a radial length dimension $l_4$, and an intersection of surface 80 and an inner cylindrical surface 86 of seat 24 may include a bevel 88 oriented at an angle $\beta$. In one specific embodiment, $l_4$ is about 3-4 mm (e.g., about 3.4-3.7 mm) resulting in a contact pressure with the tool of about 65-80 MPa. In this same embodiment, $\beta$ is about 28-32° when measured relative to a center axis of seat 24. It is contemplated that bevel 88 may be omitted or replaced with a round, if desired. By omitting bevel 88, $l_4$ may become greater, allowing for reduced contact pressure between the tool and surface 80.

Springs 26 may be designed to provide for desired operation of intake and exhaust valves 20, 22. In particular, each spring 26 may have an assembled length $l_5$, a free length $l_6$ (not shown), an outer diameter $d_2$, a wire diameter $d_3$, and an assembled load $L_1$ (not shown). The dimensions $l_5$, $l_6$, $d_2$, $d_3$ and/or length $L_1$ may be the same or different when springs 26 are used with intake and exhaust valves 20, 22. In one specific embodiment, inner spring 26*a* has length $l_5$ about equal to 55-60 mm (e.g., about 57.5 mm), a free length $l_5$ about equal to 70-75 mm (e.g., about 73 mm), an outer diameter $d_2$ about equal to 30-31 mm (e.g., about 30.4 mm), a wire diameter $d_3$ about equal to 3.75-4.25 mm (e.g., about 4 mm), and an assembled load $L_1$ about equal to 250-300 N (e.g., about 275 N). In this same embodiment, outer spring 26*b* has length $l_5$ about equal to 58-62 ram (e.g., about 60.29 mm), a free length $l_6$ about equal to 75-80 mm (e.g., about 77.07 mm), an outer diameter $d_2$ about equal to 43-44 mm (e.g., about 43.47 mm), a wire diameter $d_3$ about equal to 5-6 mm (e.g., about 5.54 mm), and an assembled load $L_1$ about equal to 500-550 N (e.g., about 510 N). Thus, in this embodiment, a combined assembled load $L_1$ from both inner and outer springs may be about 750-850 N (e.g., about 785 N).

Rotocoil 28 may fulfill at least two functions. First, rotocoil 28 may function as a spring retainer, keeping springs 26 in compression at their desired locations around the corresponding valve. Second rotocoil 28 may function to rotate the corresponding valve somewhat during each opening/closing event, thereby inhibiting burning of the valve through even distribution of heat loads across the face of the valve. And while performing the first and second functions described above, rotocoil 28 should avoid engagement with valve bridges 44, 46. Rotocoil 28 may have a generally cylindrical body 79 with a narrow diameter portion configured to reside inside inner spring 26*a*, an outer housing 81 configured to rest on an axial end of inner and outer springs 26*a*, 26*b*, and a spiral spring 83 disposed within a channel between body 79 and housing 81. In one embodiment, the spring or distal end (i.e., the end inside of inner spring 26*a*) of body 79 may be blunt (i.e., without piloting features), and rotocoil 23 may have an overall axial length $l_7$, an outer diameter $d_4$, and an internal chamfer having an angle $\alpha$ at a bridge or base end. The dimensions $l_7$, and $d_4$ may be the same or different when rotocoils 28 are used with intake and exhaust valves 20, 22. In one specific embodiment, when rotocoil 28 is intended for use with intake valve 20, $l_7$ is about 15.75-16.25 mm (e.g., about 16 mm), $d_4$ is about 43-44 mm (e.g., about 43.765 mm), and $\alpha$ is about 21-24° (e.g., about 22.5°) when measured relative to a center axis of rotocoil 28. In another specific embodiment, when rotocoil 28 is intended for use with exhaust valve 22, $l_7$ is about 17.5-18 mm (e.g., about 17.73 mm), $d_4$ is about 43-44 mm (e.g., about 43.765 mm), and $\alpha$ is about 26-28° (e.g., about 27.5°).

Guides 64 may function to guide intake and exhaust valves 20, 22 during their reciprocating motions. Each guide 64 may be generally cylindrical and hollow, extending in an axial direction of stem 70. At least a portion (e.g., a bottom end portion) of guide 64 may be pressed into a recess of cylinder head 18, thereby securing guide 64 in place. In one embodiment, a stem seal 84 may be placed over the free portion (i.e., the portion not pressed into cylinder head 18) and configured to engage outer surfaces stem 70 in order to inhibit oil leakage through cylinder head 18 at the associated valve. In the example depicted in FIG. 2, stem seal 84 is a double gas lip seal. It is contemplated, however, that stem seal 84 could alternatively be a labyrinth seal, if desired. It is also contemplated that intake and exhaust valves 20, 22 could have different types of stem seals 84 within the same system 12. Guide 64 may have a free length (i.e., a length not inserted into cylinder head 18) $l_8$; and stem seal 84 may have a length $l_9$, a base diameter $d_5$, and a tip diameter $d_6$. In one example, $l_8$ is about 27-27.5 mm (e.g., about 25.25 mm); $l_9$ is about 31-33 mm (e.g., about 32 mm); $d_5$ is about 43-45 mm (e.g., about 44.5 mm); and $d_6$ is about 20-21 mm (e.g., about 20.53 mm).

Figure 4:
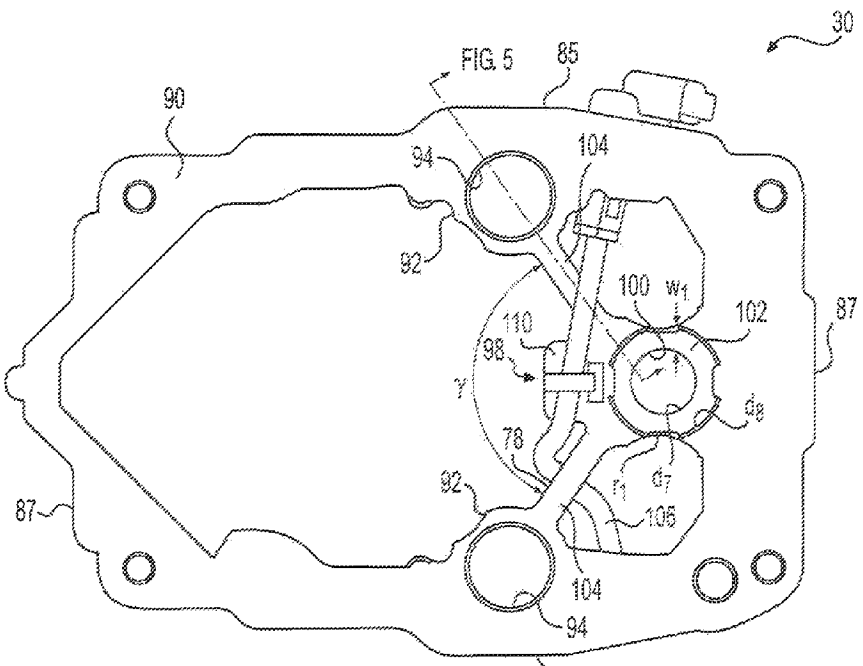
FIGS. 3-5 are isometric, top, and cross-sectional illustrations, respectively, of an exemplary disclosed rocker base that may be used in conjunction with the valve actuation system of FIG. 1.
Figure 3:
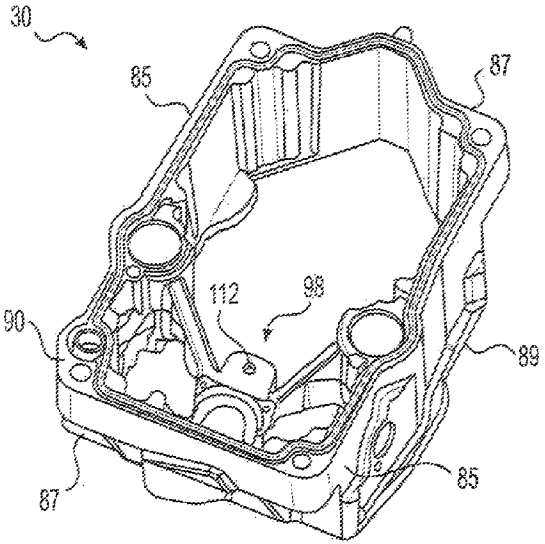
Figure 5:
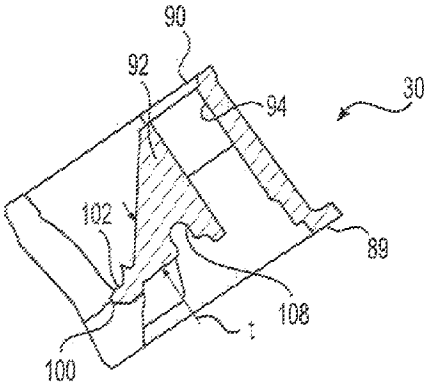

FIGS. 3-5 illustrate an exemplary embodiment of base 30 configured to support operation of system 12. Base 30 may be a generally box-like housing formed through a casting process (e.g., a high-pressure aluminum die casting process) to have side walls 85, end walls 87, a bottom 89, and a top 90 located at a side opposite bottom 89. Bottom 89 may be configured to engage cylinder head 18, while top 90 may be engaged by a valve cover (not shown). A seal 91 (shown only in FIG. 1) may be placed at one or both of bottom and top sides 89, 90 to seal the base-to-head and/or base-to-cover connections, if desired.

Two or more internal supports 92 may be integrally formed at opposing side walls 85 of base 30, and configured to receive posts or inserts (removed from FIG. 1 for clarity) of rocker shaft 42. In the disclosed embodiment, supports 92 are bosses having recesses or through-holes 94 into which the posts or inserts are assembled. Fasteners (not shown) may then be passed through the posts or inserts to threadingly engage cylinder head 18 below, thereby connecting rocker shaft 42 (and system 12) to cylinder head 18. It is contemplated that removable wear sleeves or liners may first be placed in through-holes 94, if desired. A plurality of additional through-holes 96 (e.g., four through-holes 96) may be formed around a periphery of base 30 (e.g., at corners thereof), and used to connect base 30 to cylinder head 18 via additional threaded fasteners (not shown).

An injector spring pad ("pad") 98 may be formed at the end wall 87 closest to supports 92 (i.e., at the end wall 87 located in the same half of base 30 as supports 92), and configured to provide reaction support for injector spring 54 (referring to FIG. 1). Pad 98 may be generally centered between supports 92, and protrude a distance from end wall 87 toward a center of base 30. Pad 98 may be generally plate-like, inclined toward top 90 (e.g., by about 9-10°), and include a through hole 100 that provides clearance for injector pushrod 50 (referring to FIG. 1). Through-hole 100 may have a diameter $d_7$. A recess 102 may be machined into an upper surface of pad 98 to provide seating for spring 54. Recess 102 may have an outer diameter $d_8$. In one embodiment, $d_7$ is about 24-26 mm (e.g., about 25 mm), and $d_8$ is about 40-41 mm (e.g., about 40.7 mm).

The areas inside base 30 that are located to the sides of pad 98 (i.e., between pad 98 and side walls 85) may be left open to accommodate valve pushrods 36. In embodiments having lash-adjusters 58, more space may be required in these areas than in other embodiments that do not have lash adjusters 58. In order to accommodate both embodiments, the sides of pad 98 at these areas may curve inward. That is, the sides of pad 98 may be generally concave in order to maintain clearance around lash adjusters 58, and recess 102 may be truncated at these concave sides. The clearance around lash adjusters 58 at the concave areas of pad 98 may have a radius $r_1$, such that the concave sides of pad 98 have a width $w_1$. In one embodiment, $r_1$ is about 18-20 mm (e.g., about 19 mm), and $w_1$ is about 7-8 mm (e.g., about 7.5 mm).

Because pad 98 may be concave at its sides, a strength of pad 98 may be reduced. In some instances, this reduction could result in overloading of pad 98 by injector spring 54. In order to provide for the required reaction support and stiffness, one or more ribs 104 may be integrally formed in base 30 that extend from side walls 85 to pad 98. As shown in the embodiment of FIG. 4, two ribs 104 are placed symmetrically inside base 30. Ribs 104 may extend from an inner side of supports 92 toward pad 98, such that ribs 104 together form a general V-shape. An interior angle γ located between ribs 104, in the disclosed embodiment, is about 110-115° (e.g., about 112°).

As shown in FIG. 5, ribs 104 may be thickest at supports 92, and taper along their lengths to pad 98. Specifically, a bottom surface of ribs 104 may be generally flat and parallel with bottom 88 and top 90 of base 30, while a top surface of rib 104 may angle downward from top 90 toward pad 98. In one embodiment, a thickness t of ribs 104 reduces by about 50-60% along the lengths of ribs 104.

In order to ensure adequate strength of pad 98, one or more processes may be performed on base 30 after fabrication of pad 98. For example, a shot-peening process may be performed at an intersection of pad 98 with ribs 104 and/or at an intersection of pad 98 and wall 87. In the disclosed embodiment, the shot-peening process may include using S230 cast shot, with an intensity of about 25-36 mm. This process may result in a residual stress at these areas of about 110 N.

When system 12 is used with an electrically-actuated injector, a wiring harness 106 may need to be routed to the injector. This routing, in one embodiment, may pass through one or both ribs 104. For example, one or both ribs 104 may include a recess 108 located within the bottom surface. Wiring harness 106 may be positioned within recess 108, and a retention mechanism (not shown) may be placed over wiring harness 106 to keep wiring harness 106 inside of recess 108.

In some embodiments, additional means of retention may be necessary to properly position wiring harness 106 relative to base 30. In these embodiments, a tab 110 may protrude from pad 98 toward the center of base 30; a through-hole 112 may be formed within tab 110; and a retention member (e.g. a fire-tree—not shown) may be placed (snap-fit or threaded) into through-hole 112. The retention member may wrap around wiring harness 106 to position wiring harness 106 against tab 110. After passing over tab 110 and through recess 108, wiring harness may be run the length of base 30, within a groove (not shown) formed in bottom 89 at side wall 85.

INDUSTRIAL APPLICABILITY

The disclosed rocker base may have applicability with internal combustion engines. In particular, the disclosed rocker base may be used to house and support a variety of different valve actuation systems. The disclosed rocker base may provide clearance for the different components of the valve actuation system, while still maintaining a necessary strength and stiffness. Specifically, the disclosed rocker base may provide a support pad for an associated injector spring, but also have enough clearance at the sides of the support pad for any lash adjusters that might be included in the valve actuation system. In addition, the disclosed rocker base may include ribs that provide added strength and rigidity to the support pad.

It will be apparent to those skilled in the art that various modifications and variations can be made to the rocker base of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A rocker base, comprising:

a housing having a top, a bottom, side walls connecting the top to the bottom, and end walls disposed between the side walls;

rocker arm supports located inside the housing and integrally formed with the side walls;

an injector spring pad extending from one of the end walls toward a center of the housing; and first and second ribs, the first rib extends from a first of the rocker arm supports to the injector spring pad, the second rib that extends from a second of the rocker arm supports to the injector spring pad, wherein the first and second ribs form a general V-shape, the first and second ribs have a generally flat bottom surface and a top surface that tapers toward the injector spring pad, wherein an interior angle between the first and second ribs is about 110-115°; and a wiring harness recess formed in the generally flat bottom surface of the first and second ribs, wherein:

open spaces exist inside the housing at areas adjacent the injector spring pad;

the injector spring pad includes an injector pushrod through-hole and a width of the injector spring pad between the injector pushrod through-hole and the sides of the injector spring pad is about 7-8 mm; and the sides of the injector spring pad at the open spaces are concave.

2. The rocker base of claim 1, wherein the injector spring pad is centered between the rocker arm supports.

3. The rocker base of claim 1, wherein the injector spring pad is generally plate-like, and inclined toward the top of the housing.

4. The rocker base of claim 3, wherein the injector spring pad is inclined by about 9-10° relative to the top of the housing.

5. A rocker base, comprising:

a housing having a top, a bottom, side walls connecting the top to the bottom, and end walls disposed between the side walls;

first and second rocker arm supports located inside the housing and integrally formed with the side walls;

an injector spring pad extending from one of the end walls toward a center of the housing, the injector spring pad being centered between the first and second rocker arm supports and inclined toward the top of the housing; and first and second ribs connecting the injector spring pad to the first and second rocker arm supports, wherein:

the first and second ribs form a general V-shape; and open spaces exist inside the housing at areas adjacent the injector spring pad.

6. The rocker base of claim 5, wherein at least one of the first and second ribs has a generally flat bottom surface, a top surface that tapers toward the injector spring pad, and a wiring harness recess formed in the generally flat bottom surface.

7. The rocker base of claim 5, further including:

a tab extending from the injector spring pad toward the center of the housing; and a wiring harness mounting hole formed in the tab.

8. An engine, comprising:

an engine block;

a cylinder head connected to the engine block;

a valve actuation system configured to selectively open passages in the cylinder head; and a rocker base connected to the cylinder head and configured to house the valve actuation system, the rocker base including:

a housing having a top, a bottom configured to engage the cylinder head, side walls connecting the top to the bottom, and end walls disposed between the side walls;

first and second rocker arm supports located inside the housing, being integrally formed with the side walls, and configured to support the valve actuation system;

an injector spring pad extending from one of the end walls toward a center of the housing, the injector spring pad being centered between the first and second rocker arm supports and inclined toward the top of the housing; and first and second ribs connecting the injector spring pad to the first and second rocker arm supports, wherein:

the first and second ribs form a general V-shape; and open spaces exist inside the housing at areas adjacent the injector spring pad.

9. The engine of claim 8, wherein at least one of the first and second ribs has a generally flat bottom surface, a top surface that tapers toward the injector spring pad, and a wiring harness recess formed in the generally flat bottom surface.

10. The engine of claim 8, further including:

a tab extending from the injector spring pad toward the center of the housing; and a wiring harness mounting hole formed in the tab.

* * * * *